United States Patent [19]

Miller

[11] Patent Number: 4,473,225

[45] **Date of Patent: * Sep. 25, 1984**

[54] DOORWAY MOUNTED HORIZONAL BAR

[75] Inventor: Jack V. Miller, Sierra Madre, Calif.

[73] Assignee: Gravity Guidance, Inc., Duarte, Calif.

[ * ] Notice: The portion of the term of this patent subsequent to Sep. 20, 2000 has been disclaimed.

[21] Appl. No.: 532,359

[22] Filed: Sep. 15, 1983

Related U.S. Application Data

[63] Continuation of Ser. No. 376,513, May 10, 1982, Pat. No. 4,405,127.

[51] Int. Cl.[3] ..... A63B 1/00

[52] U.S. Cl. ..... 272/62; 248/264

[58] Field of Search ..... 272/62, 146, 900; 248/224.1, 254, 224.2, 223.4, 264, 251, 201; 211/105.1, 105.3, 123; D8/363, 366; D6/130, 131

[56] References Cited

U.S. PATENT DOCUMENTS

| | | | |
|---|---|---|---|
| 2,443,149 | 6/1948 | Rundell | 248/264 |
| 3,525,521 | 8/1970 | Sylvester | 272/62 |
| 3,738,650 | 6/1973 | Ossenkop et al. | 272/62 |

*Primary Examiner*—Richard J. Apley
*Assistant Examiner*—S. R. Crow
*Attorney, Agent, or Firm*—Zarley, McKee, Thomte, Voorhees & Sease

[57] ABSTRACT

The horizontal bar includes tubular members freely telescopically interconnected having laterally extending end plates wedged-shaped and received in doorway brackets on opposite sides of the doorway. The brackets are wedged-shaped and include a passageway narrower in width to provide a friction fit between the side edges of the plates and the lateral ends of the brackets.

1 Claim, 6 Drawing Figures

DOORWAY MOUNTED HORIZONAL BAR

This is a continuation of application Ser. No. 376,513, filed May 10, 1982, now U.S. Pat. No. 4,405,127.

BACKGROUND OF THE INVENTION

A chinning bar or horizontal bar for hanging either by the hands or the feet is needed that may be safely installed in a doorway and limited against movement but yet be easily removed, if desired, without removing the support brackets secured to the opposite sides of the doorway. The bar should easily and quickly adapt to various doorways by being longitudinally adjustable lengthwise.

SUMMARY OF THE INVENTION

The horizontal bar is freely telescopically longitudinally movable such that it will adapt to any doorway width by merely extending or contracting the bar. Wedged-shaped plates are rigidly secured to the opposite ends of the tubular members and are received in passageways formed in brackets mounted on opposite side of the doorway.

The brackets are one piece with front and back walls interconnected by opposite end walls. The distance between the opposite end walls is smaller than the width of the end plates on the tubular telescoping members and thus provide the friction fit between the end plates and the brackets.

DESCRIPTION OF THE PREFERRED EMBODIMENT

Figure 1:
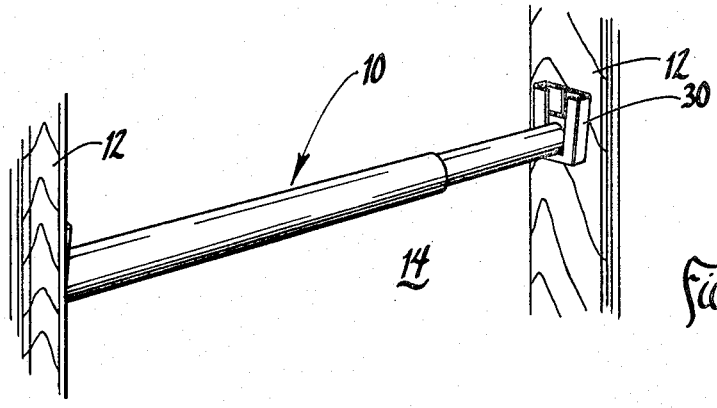
FIG. 1 is a perspective view of the horizontal bar mounted in a doorway.
Figure 2:
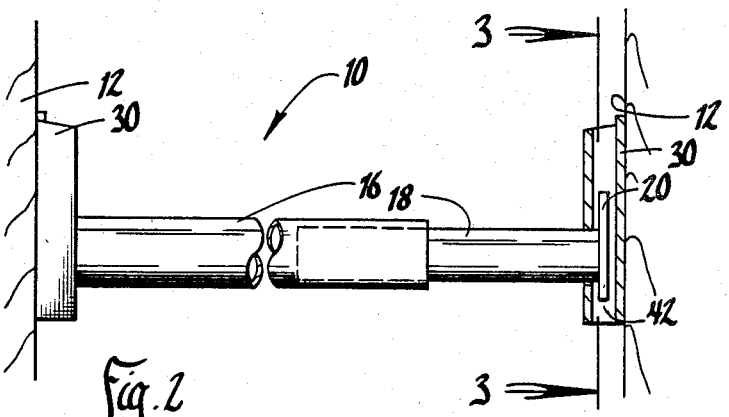
FIG. 2 is a fragmentary side elevational view thereof.
Figure 3:
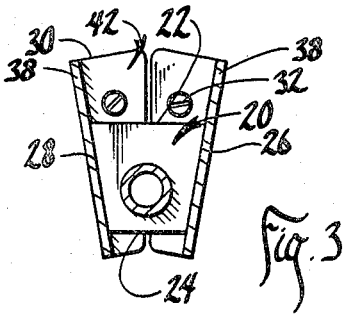
FIG. 3 is a cross-sectional view taken along line 3—3 in FIG. 2.
Figure 6:
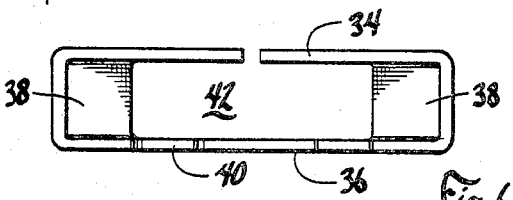
FIG. 6 is a top plan view thereof.
Figure 4:
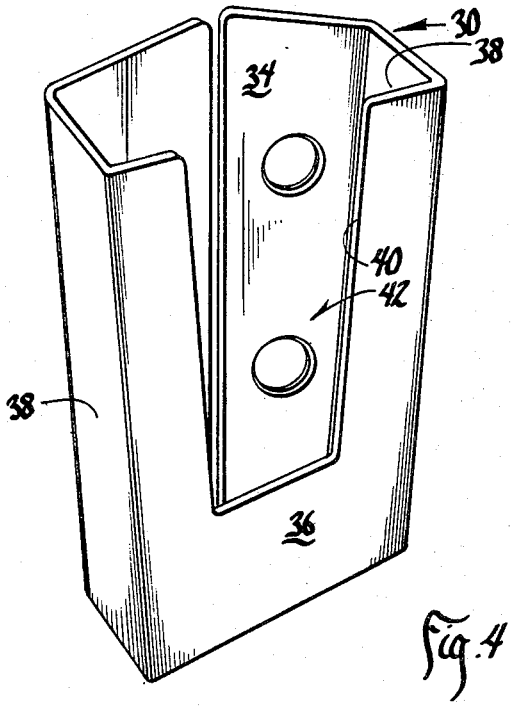
FIG. 4 is a perspective view of the bracket only.
Figure 5:
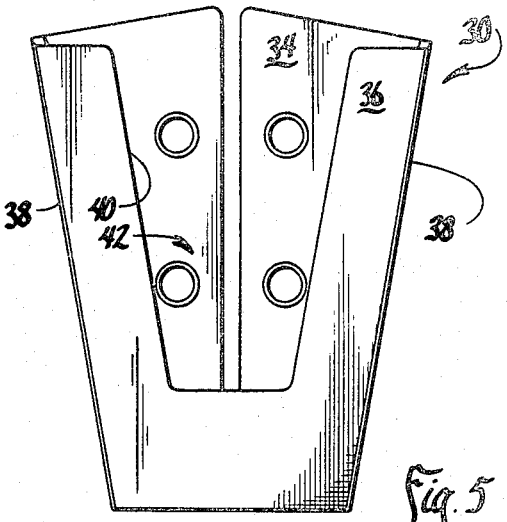
FIG. 5 is a front elevational view thereof.

The horizontal bar of this invention is referred to generally in FIG. 1 by the reference numeral 10 and is shown mounted to the side moldings 12 of a doorway 14.

The bar includes two tubular members, 16 and 18, telescopically interconnected anf free to move longitudinally to the desired length to fit most doorways 14. No screws threads or the like are provided between the telescopic members 16 and 18.

An end plate 20 is provided on the outer end of each telescopic member 16 and 18 and is wedged shaped downwardly having top and bottom edges 22 and 24 and opposite tapered side edges 26 and 28.

The end plates are received in brackets 30 secured to the moldings 12 by screws 32. Each bracket is integrally constructed and includes an outer wall 34 and an inner wall 36 interconnected by opposite end portions 38. The inner wall 36 has a cutout portion 40 to receive the adjacent telescopic members 16 and 18. The plates 20 are friction fitted into the brackets 30 with the side edges 26 and 28 engaging the end portions 38.

It is thus seen that the bar 10 is held in place against further longitudinal or rotational movement and cannot move any further downwardly. The bar can be removed from the brackets 30 by merely lifting it upwardly such that the plates 20 move out of the chamber 42 formed in each of the brackets 30. Accordingly, the bar 10 may be quickly installed or removed since it is very easy to manually extend it to the correct length for the plates 20 to drop into the bracket passageways 42.

With the bar 10 mounted in the doorway it is available for use as a chinning bar or for other brachiation type exercises including hanging upside-down through the use of ankle devices carrying hooks or the like.

I claim:

1. A doorway mounted horizontal bar comprising, a pair of telescoping tube members, end plates at opposite ends of said tube members, said end plates vertically arranged and having opposite side edges, mounting brackets adapted to be secured to opposite sides of the doorway supporting said end plates, said mounting brackets each having inner and outer parallel walls interconnected by laterally disposed end walls and forming a passageway open at the top, said end plates being positioned in said passageways to thereby firmly hold and support said telescoping members and limit them from longitudinal movement, and each of said outer walls comprising a pair of non-connecting lips projecting towards one another from each of said end walls, each of said lips having opening means for mounting said bracket to the side frame of said doorway and limiting relative movement between said lips, said inner wall of each of said mounting brackets comprising a pair of lips projecting towards one another from each of said end walls and having upper and lower portions, said lips being integrally connected only at said lower portion to form a notch in said upper portion adapted to receive the adjacent portion of said telescoping tube member, and said connection at said lower portion of said inner walls preventing outward deflection of said lips when downward force is exerted on said telescoping members mounted in said brackets.

* * * * *